US007954255B2

(12) United States Patent
Sawa

(10) Patent No.: US 7,954,255 B2
(45) Date of Patent: Jun. 7, 2011

(54) DRYING APPARATUS WITH A SOLVENT-RECOVERY FUNCTION, AND A METHOD FOR DRYING SOLVENT RECOVERY

(76) Inventor: Kohei Sawa, Wakayama (JP)

( * ) Notice: Subject to any disclaimer, the term of this patent is extended or adjusted under 35 U.S.C. 154(b) by 208 days.

(21) Appl. No.: 12/339,474

(22) Filed: Dec. 19, 2008

(65) Prior Publication Data

US 2010/0154246 A1 Jun. 24, 2010

(51) Int. Cl.
*F26B 21/00* (2006.01)

(52) U.S. Cl. ..... 34/567; 34/572

(58) Field of Classification Search ..... 34/468, 34/565, 567, 569, 343, 348, 572
See application file for complete search history.

(56) References Cited

U.S. PATENT DOCUMENTS 5,689,848 A * 11/1997 Saal et al. ..... 34/131

FOREIGN PATENT DOCUMENTS

JP 2003-311095 11/2003

* cited by examiner

*Primary Examiner* — Jiping Lu
(74) *Attorney, Agent, or Firm* — Reising Ethington P.C.

(57) ABSTRACT

A drying apparatus with a vaporized-solvent-recovery function including: a concentration-at-the-end-of-drying data memorizing device to memorize a concentration of a vaporized solvent at the end of a drying operation of an object to be dried in a processing path; a vaporized solvent; an end-of-drying judging device to judge an end of drying of the object by comparing the concentration measured by the vaporized-solvent-concentration measuring device with the concentration memorized by the concentration-at-the-end-of-drying data memorizing device; and a drying-operation controlling device to control the drying operation of the object in a processing bath and to end the drying operation in response to a judgement by the end-of-drying judging device that the concentration measured by the vaporized-solvent-concentration measuring device is equal to the concentration memorized in then concentration-at-the-end-of-drying data memorizing device.

2 Claims, 4 Drawing Sheets

DRYING APPARATUS WITH A SOLVENT-RECOVERY FUNCTION, AND A METHOD FOR DRYING SOLVENT RECOVERY

CROSS REFERENCE TO RELATED APPLICATIONS

This application is on the basis of Japanese Patent Application No. 2006-191266, the contents of which is hereby incorporated by reference.

FIELD OF THE INVENTION

The present invention relates to a drying apparatus with a solvent-recovery function to recover a vaporized solvent from a dried object in a bath, and a method for drying solvent recovery.

BACKGROUND

In the cleaning industry, a solvent such as a cleaning fluid remaining in a cleaned object (dried object) may not only become a source origin of the volatile organic compound (VOC) to worsen a working environment, but also cause a chemical burn when wearing the cleaned object. Therefore, cleaned objects are sufficiently dried, and classified.

In a case of a drying apparatus not with a vaporized-solvent-recovery function of volatized solvent, the solvent volatized from the cleaning object is exhausted outside. However, it is known that an emission volume of VOC can be restrained by using a drying apparatus with a vaporized-solvent-recovery function. Further, because the drying apparatus with a vaporized-solvent-recovery function recovers and reuses the solvent which has been discharged to the air, an amount of solvent usage and a cost are reduced. Therefore, the cleaning industry converts the drying apparatus into that with a vaporized-solvent-recovery function.

In such a drying apparatus with a vaporized-solvent-recovery function, the solvent is vaporized from the cleaned object with hot air, and the gasified solvent is cooled and liquefied with a cooler. Then, the liquefied gas is separated into the solvent and water with a water separator, and the solvent is recovered. Then, the solvent recovered by the drying apparatus with a recovery function is reused.

Patent Document 1 discloses a dry-cleaning machine which cools the vaporized solvent. This dry-cleaning machine uses a common freezing machine with respect to two coolers of a solvent cooler and a drying cooler to maintain the solvent at sufficiently low temperature with a low cost (for example, Japanese Published Patent Application No. 2003-311095).

As described above, in the cleaning industry, conventionally, due to cooling the solvent, a discharge amount of VOC is restrained and an amount of solvent usage is reduced. However, in a case that a limonene which is low cost, has low toxicity on the human body, and has bactericidal effects is used as the solvent, because a lemon-like odor of the limonene is remained in the cleaned object when the cleaning object is half dried, the drying time of the conventional drying apparatus with a vaporized-solvent-recovery function is sufficiently long for fully vaporizing the solvent.

Essentially, the drying time of the cleaned object such as clothes is varied according to the structure of the cleaned object. However, in the cleaning industry, various kinds of cleaned object are dried at once. Therefore, the cleaned object is generally dried too much, and may be damaged. Further, in a case that the solvent is limonene, because the limonene is flammable, the drying time cannot be long, so that the cleaned object may be half dried. In this case, there is a problem that the recovery rate of the solvent is reduced. Such a problem is not limited to the cleaning industry, but the overall drying apparatus in which the vaporized solvent is recovered in a drying operation.

Accordingly, an object of the present invention is to provide a drying apparatus with a vaporized-solvent-recovery function and a method for drying solvent recovery to be able to increase a recovery rate of a solvent and to reduce damage to a dried object caused by too much drying.

SUMMARY OF THE INVENTION

In order to attain the object, according to the present invention, as shown in a basic configuration view of FIG. 1, there is provided a drying apparatus with a vaporized-solvent-recovery function including:

a concentration-at-the-end-of-drying data memorizing device 11*a* to memorize a concentration of a vaporized solvent at the end of a drying operation of an object to be dried in a processing path 2;

a vaporized-solvent-concentration measuring device 8 to measure a concentration of the vaporized solvent;

an end-of-drying judging device 10*b* to judge an end of drying of the object by comparing the concentration measured by the vaporized-solvent-concentration measuring device 8 with the concentration memorized by the concentration-at-the-end-of-dying data memorizing device 11*a*; and a drying-operation controlling device 10*a* to control the drying operation of the object in a processing bath 2 and to end the drying operation in response to a judgement by the end-of-drying judging device 10*b* that the concentration measured by the vaporized-solvent-concentration measuring device 8 is equal to the concentration memorized in the concentration-at-the-end-of-drying data memorizing device 11*a*.

According to the above, firstly, the concentration-at-the-end-of-drying data memorizing device 11*a* memorizes the concentration of the vaporized solvent at the end of drying of the object to be dried. Then, when the drying operation with respect to the object in the processing bath 2 is carried out under the control of the drying-operation controlling device 10*a*, the vaporized solvent is liquefied and recovered, and the vaporized-solvent-concentration measuring device 8 measures the concentration of the vaporized solvent. Then, the end-of-drying judging device 10*b* compares the measured concentration with the concentration memorized in the concentration-at-the-end-of-drying data memorizing device 11*a*. Then, when the end-of-drying judging device 10*b* judges that the measured concentration is equal to the concentration-at-the-end-of-drying data, the drying-operation controlling device 10*a* ends the drying operation.

Preferably, as shown in the basic configuration view of FIG. 1, the dying apparatus with a vaporized-solvent-recovery function further including:

a flash-concentration-data memorizing device 11*b* to memorize a flash concentration of the vaporized solvent;

a flash concentration judging device 10*c* to judge whether the concentration of the vaporized solvent in the processing bath 2 is the flash concentration or not by comparing the concentration measured by the vaporized-solvent-concentration measuring device 8 with the flash concentration memorized in the flash-concentration-data memorizing device 11*b*; and a flash preventing device 10*d* to decrease at least one of the concentration of the vaporized solvent or the temperature in the processing bath 2 in response to a judgement by the flash concentration judging device 10*c* that the measured concentration is equal to the flash concentration.

According to the above, the flash-concentration-data memorizing device 11*b* memorizes the flash concentration of the vaporized solvent. Then, the flash concentration judging device 10*c* compares the concentration measured by the vaporized-solvent-concentration measuring device 8 with the flash concentration memorized in the flash-concentration-data memorizing device 11*b*. If the flash concentration judging device 10*c* judges that the measured concentration is equal to the flash concentration, the flash preventing device 10*d* degreases the concentration of the vaporized solvent or the temperature in the processing bath 2.

Preferably, as shown in the basic configuration view of FIG. 1, the dying apparatus with a vaporized-solvent-recovery function further including:

a flash-temperature-data memorizing device 11*c* to memory a flash temperature of the vaporized solvent at which the vaporized solvent flashes off, a temperature measuring device 5 to measure the temperature in the processing bath 2; and a flash temperature judging device 10*e* to judge whether the temperature in the processing bath 2 is equal to the flash temperature or not by comparing the temperature measured by the temperature measuring device 5 with the flash temperature memorized in the flash-temperature-data memorizing device 11*c*, wherein the flash preventing device 10*d* decreases at least one of the concentration of the vaporized solvent or the temperature in the processing bath 2 in response to a judgement by the flash temperature judging device 10*e* that the temperature measured by the temperature measuring device 5 is equal to the flash temperature memorized in the flash-temperature-data memorizing device 11*c*.

According to the above, the flash-temperature-data memorizing device 11*c* memorizes the flash temperature at which the vaporized solvent flashes off. Then, the flash temperature judging device 10*e* compares the temperature measured by the temperature measuring device 5 and the flash temperature memorized in the flash-temperature-data memorizing device 11*c*. When the flash temperature judging device 10*e* judges that the temperature measured by the temperature measuring device 5 is equal to the flash temperature, the flash preventing device 10*d* decreases at least one of the concentration of the vaporized solvent or the temperature in the processing bath 2.

According to another aspect of the present invention, there is provided a method for drying solvent recovery including the steps of:

starting a drying operation for drying an object to be dried in a processing bath;

measuring a concentration of a vaporized solvent;

judging whether the measured concentration is equal to a predetermined concentration-at-the-end-of-drying data or not;

liquefying and recovering the vaporized solvent; and stopping the drying operation in response to a judgement that the measured concentration is equal to the predetermined concentration.

According to the above, while the object to be dried is dried, the concentration of the vaporized solvent is measured. When judging that the measured concentration is equal to the predetermined concentration-at-the-end-of-drying data, the drying operation in the processing bath is stopped.

BRIEF DESCRIPTION OF THE DRAWINGS

These and other objects, features, and advantages of the present invention will become more apparent upon reading of the following detailed description along with the accompanied drawings, in which.

DETAILED DESCRIPTION OF PREFERRED EMBODIMENTS

Hereunder a drying apparatus with a vaporized-solvent-recovery function 1 according to an embodiment of the present invention will be explained with reference to FIGS. 2 to 4.

Figure 1:
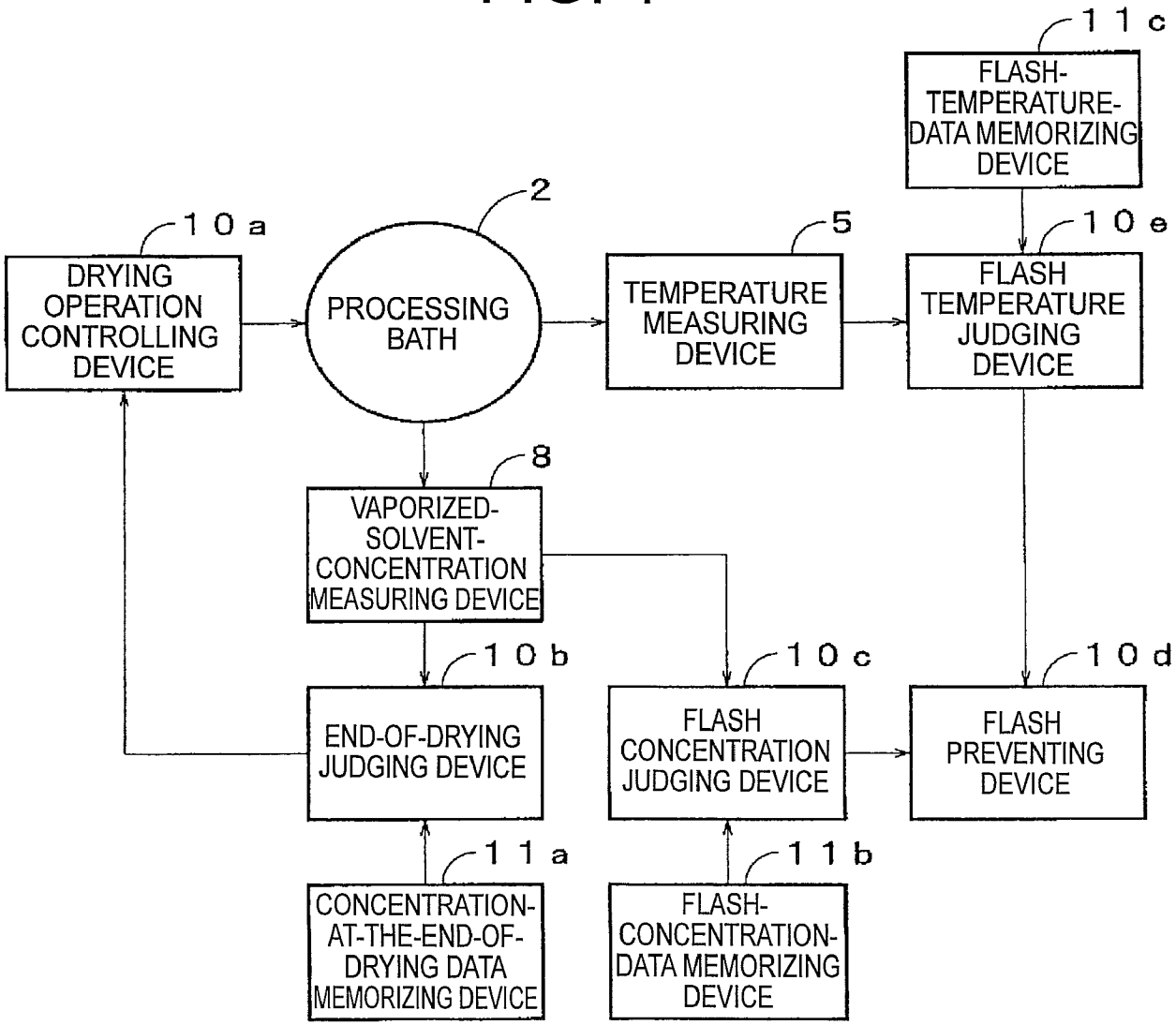
FIG. 1 is a basic configuration view of a drying apparatus with a vaporized-solvent-recovery function according to the present invention.
Figure 2:
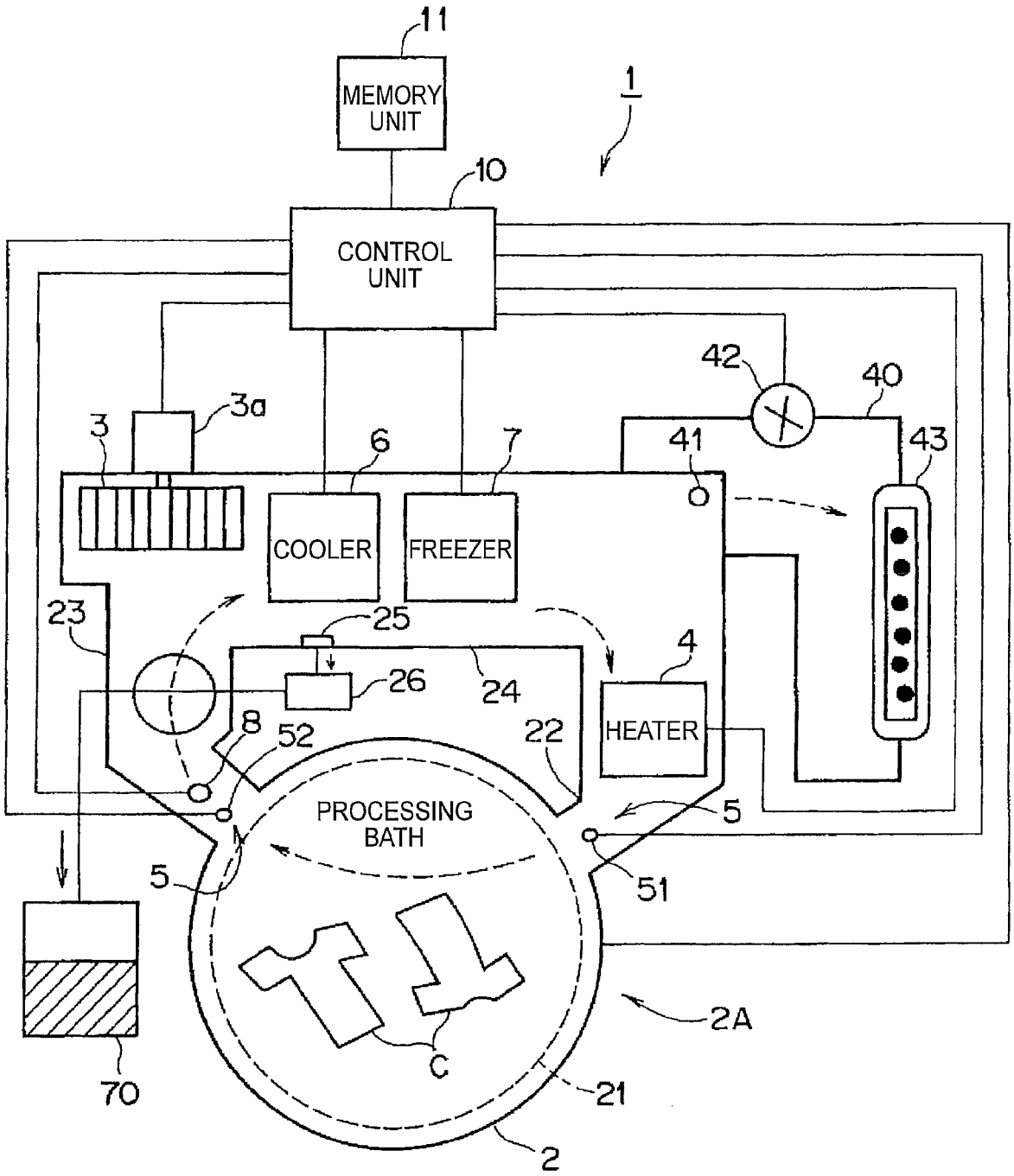
FIG. 2 is a schematic view of the drying apparatus with a vaporized-solvent-recovery function according to the present invention.
Figure 3:
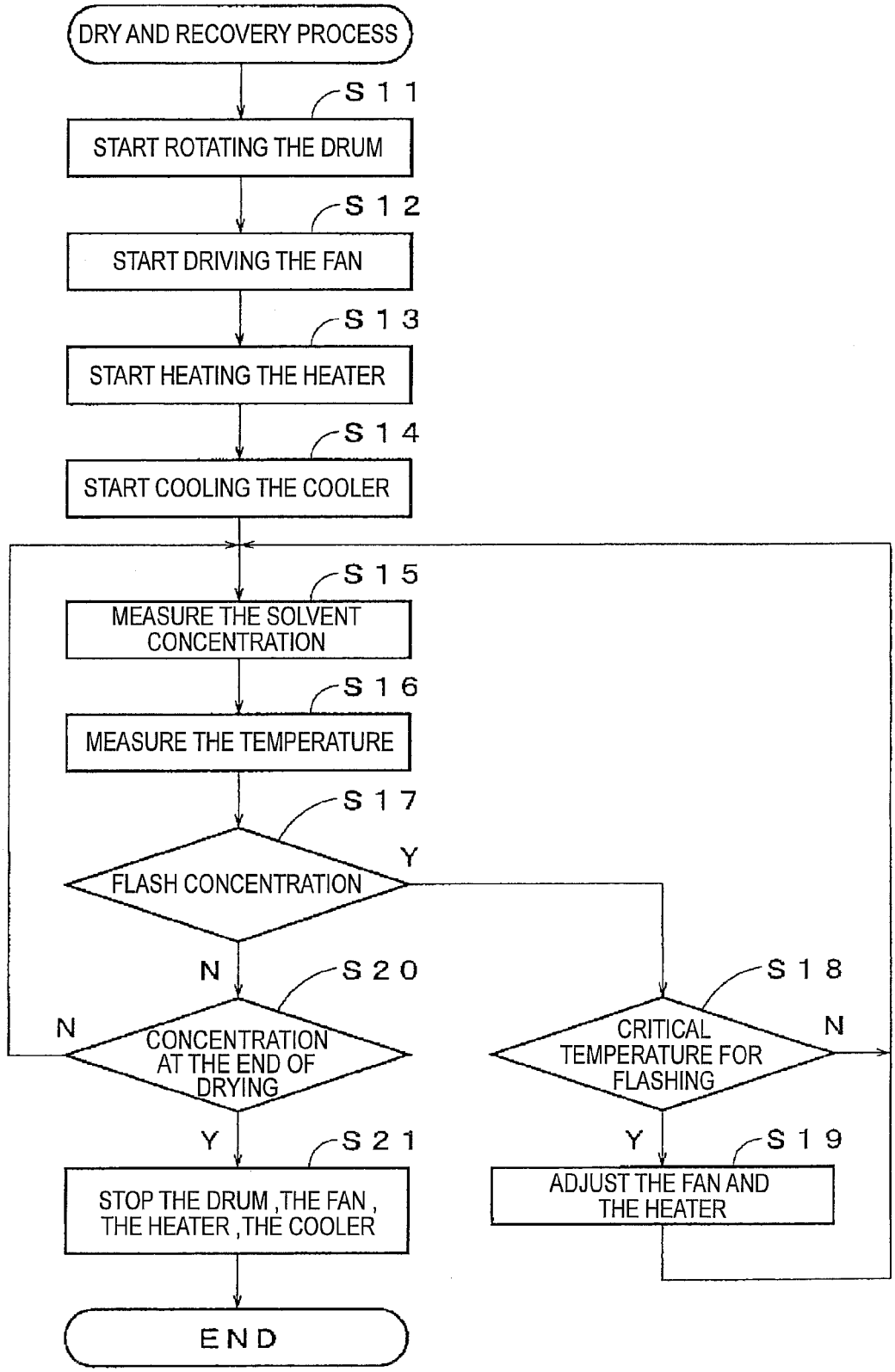
FIG. 3 is a flowchart showing an example of a recovering and drying operation performed by a control unit of FIG. 2 according to the present invention.

In FIG. 2, the drying apparatus with a vaporized-solvent-recovery function 1 (hereafter referred to as the drying apparatus 1) includes: a processing bath 2; a fan 3; a heater 4; a temperature sensor 5; a cooler 6; a solvent concentration sensor 8, and a control unit 10.

The processing bath 2 rotatably and pivotally supports a rotary cylindrical drum 21 in an interior of the processing bath 2. As is generally known, the drum 21 has a lot of holes in a periphery of the drum 21. A cleaned object C as an object to be dried is received in an interior of the drum 21, and a drying operation is performed. An inlet air passage 22, an outlet air passage 23, and a not-shown exhaust passage are connected to a wall of the processing bath 2. In the drying apparatus 1, a circular air passage 2A is formed by the inlet air passage 22, the processing bath 2, the outlet air passage 23, and a connecting air passage 24.

The fan 3 is, for example, a blower fan, and interposed between the outlet air passage 23 and the connecting air passage 24. The fan 3 includes a motor 3*a* driven by a control of a control unit 10. When the fan 3 is rotated by the motor 3*a*, a sucking force of the fan 3 circulates the air in a circular air passage 2A as indicated by a dashed arrow in FIG. 2.

The heater 4 is, for example, a steam-heating type drying heater and disposed in the inlet air passage 22. When the control unit 10 activates the heater 4, high temperature steam is supplied from a not-shown boiler to an interior of the inlet air passage 22. Thus, the air passing through the inlet air passage 22 is heated by the heater 4, and fed into the processing bath 2 to perform a hot-air drying of the cleaned object in the processing bath 2, namely, to perform the drying operation.

The temperature sensor 5 works as a temperature measuring device, and includes: an inlet temperature sensor 51 disposed at a downstream side of the heater 4 in the inlet air passage 22; and an outlet temperature sensor 52 disposed in the outlet air passage 23. The inlet and outlet sensors 51, 52 are connected to the control unit 10, and respectively output temperature signals indicating the temperature of the inlet air passage 22 and the temperature of the outlet air passage 23 to the control unit 10. Then, the control unit 10 controls a rotation number of the fan 3 and the temperature of the heater 4 based on the inputted temperature signals. Incidentally, with regard to the temperature sensor 5, various embodiments may be adopted. For example, only the outlet temperature sensor 52 may be used, or the temperature sensor 5 may be disposed in the processing bath 2.

The cooler 6 is disposed in the connecting air passage 24, and includes a not-shown heat exchanger. A refrigerant which is condensed to liquid in a freezer 7 is circularly supplied to a pipe arrangement of the heat exchanger. Then, when the air fed from the outlet air passage 23 is rapidly cooled by the heat exchanger of the cooler 6, the solvent gas included in the air is condensed to liquid and dropped. The liquefied solvent flows out from a drain 25 and passes through an exhaust pipe to a water separator 26. Then, the water is removed by the water separator 26, and only the solvent is recovered in a solvent tank 70.

The solvent concentration sensor 8 works as a vaporized-solvent-concentration measuring device, and measures a vaporized solvent concentration in the vicinity of the processing bath 2. The solvent concentration sensor 8 is disposed in an interior of the outlet air passage 23, and connected to the control unit 10. Various sensors which are able to measure concentrations of the solvents such as a silicon system, a fluorine system, or a bromine system may be used as the solvent concentration sensor 8. The solvent concentration sensor 8 outputs a signal corresponding to the concentration of the solvent to the control unit 10.

Incidentally, in this embodiment, the flammable limonene is used as the solvent. Therefore, for example, a metal-oxide-semiconductor sensor which can sense the limonene is used as the solvent concentration sensor 8. Further, the solvent concentration sensor 8 may be disposed at any place in the inlet air passage 22, the processing bath 2, or the connecting air passage 24, or a plurality of solvent concentration sensors 8 may be used as long as the solvent concentration sensor 8 can measure the concentration of the solvent.

The control unit 10 controls a total system of the drying apparatus 1, and is composed of such as a microcomputer basically including: CPU; ROM; and RAM. Incidentally, the CPU executes various processes including controls of this embodiment according to a control program stored in the ROM. Data needed for CPU to execute various processes, programs, and the like are properly stored in the RAM.

A memory unit 11 is readably and writably connected to the control unit 10, and is made of such as an EEPROM. The memory unit 11 memories the concentration-at-the-end-of-drying data, the flash concentration, flash temperature, or the like. Namely, in this embodiment, the memory unit 11 works as a concentration-at-the-end-of-drying data memorizing device, a flash-concentration-data memorizing device, and a flash-temperature-data memorizing device. Each device may be realized in the ROM of the control unit 10, or various embodiments can be adopted.

The concentration-at-the-end-of-drying data includes: a concentration of the vaporized solvent at the end of drying the cleaned object (object to be dried); a range of the concentration-at-the-end-of-drying; and the like. Namely, the concentration-at-the-end-of-drying data is set arbitrarily corresponding to the types of the solvent, the object to be dried, and the like. In this embodiment, the concentration-at-the-end-of-drying data corresponds to the limonene (solvent), and includes a predetermined concentration to regulate the concentration of the vaporized solvent. The predetermined concentration data may be zero, or various embodiments can be adopted.

The flash concentration data includes the data indicating the concentration at which the vaporized solvent flashes. Because the flash concentration data is the data to prevent the vaporized solvent from flashing, the concentration in the data is a little lower than the concentration corresponding to the flash point.

The flash temperature data includes the data indicating the flash temperature at which the vaporized solvent flashes. Because the flash temperature data is the data to prevent the vaporized solvent from flashing, the temperature in the data is a little lower than the flash temperature.

A bypass air passage 40 is formed in the connecting air passage 24 and allowed to abstract the vaporized solvent from a duct 41 in the connecting air passage 24 into the bypass air passage 40. A deodorizing fan 42 and an activated charcoal 43 are disposed in the bypass air passage 40. The deodorizing fan 42 is connected to the control unit 10. When the control unit 10 drives the deodorizing fan 42, the vaporized solvent is taken from the duct 41 to the interior of the bypass air passage 40. Then, the vaporized solvent taken in the bypass air passage 40 is adsorbed to the activated charcoal 43. Thus, by recovering the solvent beyond the liquefied solvent with the activated charcoal 43, recovering efficiency is improved.

Next, an example of a recovering and drying operation performed by the control unit 10 according to the present invention will be explained with reference to a flowchart shown in FIG. 3.

In step S11, when a driving signal is outputted to a not-shown rotary driving unit for rotating the drum 21, the drum 21 starts rotating, and then the flowchart goes to step S12. Then, the rotary driving unit rotates the drum 21 at a specific rotating speed in response to the input of the driving signal.

In step S12, when the driving signal is inputted into the motor 3*a* of the fan 3, the fan 3 starts rotating, and then the flowchart goes to step S13. Then, the motor 3 rotates the fan 3 at a specific rotating speed in response to the input of the driving signal.

In step S13, when a heating signal for heating the heater 4 at a predetermined drying temperature, the heater 4 starts heating, and then the flowchart goes to step S14. Then, when the heater 4 heats the air flowing through the circular air passage 2A, a temperature in the processing bath 2 is increased to the drying temperature.

In step S14, when a cooling signal for driving at least the cooler 6 is outputted, the cooler 6 starts cooling, and then the flowchart goes to step S15. Then, when the cooler 6 cools the vaporized solvent circulating in the connecting air passage 24, the vaporized solvent is liquefied and exhausted to a solvent tank 70 via the drain 25, and thus the solvent is recovered.

In step S15, the vaporized solvent concentration is measured and stored in the RAM according to a sensing signal inputted from the solvent concentration sensor 8. In step S16, temperatures around an inlet and an outlet of the processing bath 2 are measured and stored in the RAM according to respective temperature signals inputted from an inlet temperature sensor 51 and an outlet temperature sensor 52, and then the flowchart goes to step S17.

In step S17 (flash concentration judging device), the measured vaporized solvent concentration and flash concentration data stored in the memory unit 11 are compared, and whether the vaporized solvent concentration is equal to the flash concentration or not is judged based on the comparison result. If judged that the vaporized solvent concentration is equal to the flash concentration ("Y" in step S17), the flowchart goes to step S18.

In step S18 (flash temperature judging device), the measured temperature and flash temperature data stored in the memory unit 11 are compared, and whether the measured temperature is equal to the flash temperature or not is judged based on the comparison result. If judged that the measured temperature is not equal to the flash temperature ("N" in step S18), the flowchart goes back to step S15, and the flowchart repeats the series of steps. On the other hand, if judged that the measured temperature is equal to the flash temperature ("Y" in step S18), the flowchart goes to step S19.

In step S19 (flash preventing device), a high-speed driving signal for driving the fan 3 faster is outputted to the motor 3*a*, and a low-temperature driving signal for driving the heater 4 at a lower temperature is outputted to the heater 4. Then, the flowchart goes back to step S15, and the flowchart repeats the series of steps. Thus, when the heating temperature of the heater 4 is decreased, and an air flow circulating in the circular air passage 2A flows faster, the temperature of the vaporized solvent is decreased to prevent the temperature of the vaporized solvent from reaching the flash temperature. Incidentally, with regard to the flash preventing device, various embodiments can be used, for example, the cooler 6 may cools further, or the freezer 7 may be actuated.

In step S17, if judged that the vaporized solvent concentration is not equal to the flash concentration ("N" in step S17), the flowchart goes to step S20. In step S20 (flash concentration judging device), the measured vaporized solvent concentration and concentration-at-the-end-of-drying data stored in the memory unit 11 are compared, and whether the vaporized solvent concentration is equal to the concentration-at-the-end-of-drying or not is judged based on the comparison result. If judged that the vaporized solvent concentration is not equal to the concentration-at-the-end-of-drying ("N" in step S20), the flowchart goes back to step S15, and repeats the series of steps. On the other hand, if judged that the vaporized solvent concentration is equal to the concentration-at-the-end-of-drying ("Y" in step S20), namely, judged that the cleaned object C is dried and the vaporized solvent concentration in the processing bath 2 is less than the specific concentration, the flowchart goes to step S21.

In step S21, notification data for notifying that the drying operation is ended is outputted to a display, an output device or the like (not shown), and a stop driving signal is outputted to the rotary driving unit of the drum 21, the motor 3*a* of the fan 3, and the cooler 6 to finish the drying operation. Then, the flowchart ends.

As described the above, in this embodiment, because the steps S11 to S14 and S21, which the control unit 10 performs, controls the drying operation in processing bath 2, these steps correspond to the drying-operation controlling device 10*a* in claims.

Next, an example of an operation of the drying apparatus 1 according to the present invention will be explained with reference to a graph shown in FIG. 4. Incidentally, FIG. 4 is a graph showing a time change of the vaporized solvent concentration measured by the solvent concentration sensor 8 in the drying operation. A vertical axis indicates the vaporized solvent concentration, and a horizontal axis indicates elapsed time.

When the cleaned object C which has been washed and dehydrated is received in the drum 21 of the processing bath 2, the drying apparatus 1 starts the drying operation in response to the start request of an operator. The drying apparatus 1 rotates the drum 21, drives the fan 3, and circulates the heated air and the vaporized solvent heated by the heater 4 in the circular air passage 2A to start the drying operation of the cleaned object C in the drum 21.

Figure 4:
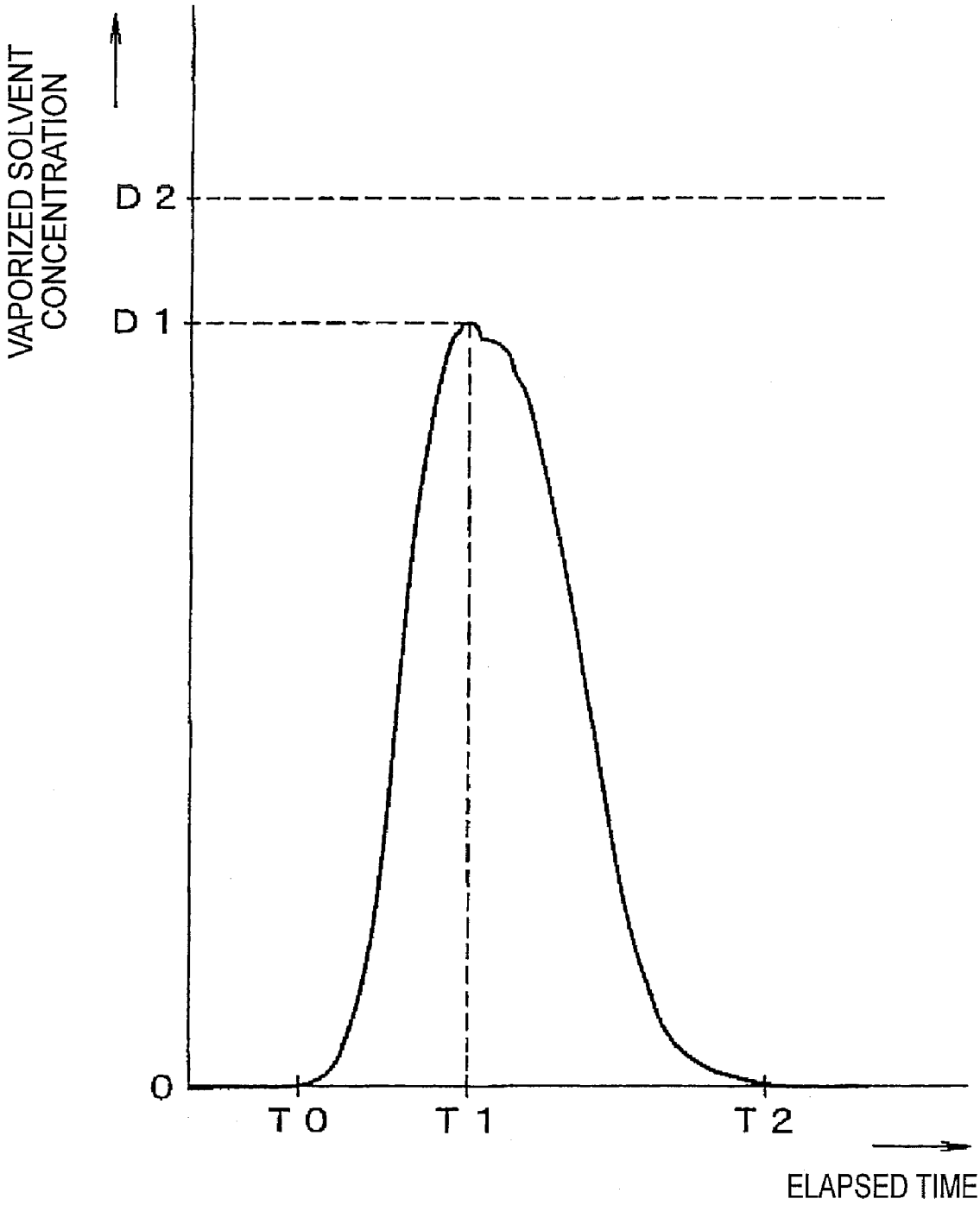
FIG. 4 is a graph showing an example of a relationship between a vaporized solvent concentration and elapsed time in a drying process.

After starting the drying operation at the time T0 in FIG. 4, the drying apparatus 1 takes samples of the outputs from the temperature measuring device 5 and the solvent concentration sensor 8 at a specific timing, and monitors the inlet temperature and the outlet temperature of the processing bath 2 based on the outputs, and monitors the concentration of the vaporized solvent around the processing bath 2. The concentration of the vaporized solvent is 0% around the time T0, and then, when the vaporized solvent from the cleaned object C is increased due to the drying operation, the concentration of the vaporized solvent is increased.

The vaporized solvent in the processing bath 2 flows toward the cooler 6 due to the sucking force of the fan 3, and the liquefied solvent by the cooler 6 flows out from the drain 25 and reaches the water separator 26. In this water separator 26, water is removed and only the solvent is recovered in the solvent tank 70. Then, the remained vaporized solvent which is not liquefied circulates in the circular air passage 2A and returns to the processing bath 2.

Then, the vaporized solvent concentration becomes the maximum concentration D1, and when the vaporized solvent vaporized from the cleaned object is decreased, the vaporized solvent concentration is decreased. Then, as the drying operation of the cleaned object C is coming to an end, the vaporized solvent concentration degreases, and at the time T2, when judged that the vaporized solvent concentration is less than the concentration-at-the-end-of-drying, namely, drying is ended, the drum 21, the fan 3, the heater 4, and the cooler 6 are stopped, and the drying operation is ended.

Thus, the drying apparatus 1 previously stores the concentration-at-the-end-of-drying the cleaned object C, measures the vaporized solvent concentration during the drying operation, compares the measured vaporized solvent concentration and the concentration-at-the-end-of-drying, and ends the drying operation when judging that the measured vaporized solvent concentration is equal to the concentration-at-the-end-of-drying. Therefore, the drying time is suited to the cleaned object C, and the cleaned object C is prevented from being damaged due to overdrying. Further, because the concentration-at-the-end-of-drying can be arbitrarily set, the drying time can reflect the structure, the material of the cleaned object C. Resultingly, the half-dried cleaned object C is prevented, the recovery rate of the solvent is increased, and the damage to the object to be dried due to overdrying is reduced. Further, because the cleaned object is prevented from being half-dried, if the limonene is used as the solvent, the residual odor of the solvent in the cleaned object C is prevented.

When the drying apparatus 1 detects the vaporized solvent concentration over the flash concentration D2 shown in FIG. 4 and detects the flash temperature by the temperature sensor 5 during the drying operation, the drying apparatus 1 adjusts the rotation number of the fan 3, and the heating temperature of the heater 4 to reduce the vaporized solvent concentration and temperature in the processing bath so as to prevent the vaporized solvent from flashing. Then, the drying apparatus 1 so controls that the vaporized solvent concentration is less than the flash concentration, and the temperature is less than the flash temperature during the drying operation.

As described the above, the drying apparatus 1 previously stores the flash concentration data of the vaporized solvent, and the flash temperature data of the vaporized solvent. When the drying apparatus 1 judges that the vaporized solvent concentration is the flash concentration by the comparison result of the vaporized solvent concentration with the flash concentration data and that the temperature is the flash temperature by the comparison result of the measured temperature with the flash temperature data, the drying apparatus 1 decreases the vaporized solvent concentration and the temperature in the processing bath 2. Therefore, even if a flammable solvent is used, the cleaned object C can be dried while the solvent does not reaches its flashing point. Therefore, a cheap but flammable limonene can be used as the solvent. Resultingly, the drying apparatus 1 contributes to the reduction of cost for drying the object to be dried. Further, even if using the cheap flammable solvent is used, the drying apparatus 1 surely manages the safety.

Thus, according to this embodiment, when both the flash concentration and the flash temperature are detected, the vaporized solvent concentration and the temperature in the processing bath 2 are decreased to prevent the solvent from flashing. However, the present invention is not limited to this. Various embodiments can be used. For example, either the vaporized solvent concentration or the temperature may be decreased to prevent the solvent from flashing. For another example, warning may be used for prevent the solvent from flashing.

Further, according to this embodiment, the drying apparatus 1 performs the drying operation. However, the present invention is not limited to this. The drying apparatus 1 may be used in a dry cleaning machine which performs all the processes of washing, rinsing, and drying.

Further, according to this embodiment, the cleaned object C is dried using the drying apparatus 1 with a vaporized-solvent-recovery function. However, the present invention is not limited to this. The drying apparatus of the present invention may dry the object to be dried and recover the vaporized solvent vaporized from the object.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A drying apparatus with a vaporized-solvent-recovery function comprising:

a concentration-at-the-end-of-drying data memorizing device to memorize a concentration of a vaporized solvent at the end of a drying operation of an object to be dried in a processing path;

a vaporized-solvent-concentration measuring device to measure a concentration of the vaporized solvent;

an end-of-drying judging device to judge an end of drying of the object by comparing the concentration measured by the vaporized-solvent-concentration measuring device with the concentration memorized by the concentration-at-the-end-of-drying data memorizing device;

a drying-operation controlling device to control the drying operation of the object in a processing bath and to end the drying operation in response to a judgement by the end-of-drying judging device that the concentration measured by the vaporized-solvent-concentration measuring device is equal to the concentration memorized in the concentration-at-the-end-of-drying data memorizing device;

a flash-concentration-data memorizing device to memorize a flash concentration of the vaporized solvent;

a flash concentration judging device to judge whether the concentration of the vaporized solvent in the processing bath is the flash concentration or not by comparing the concentration measured by the vaporized-solvent-concentration measuring device with the flash concentration memorized in the flash-concentration-data memorizing device; and a flash preventing device to decrease at least one of the concentration of the vaporized solvent or the temperature in the processing bath in response to a judgement by the flash concentration judging device that the measured concentration is equal to the flash concentration.

2. The drying apparatus with a vaporized-solvent-recovery function as claimed in claim 1 further comprising:

a flash-temperature-data memorizing device to memorize a flash temperature of the vaporized solvent at which the vaporized solvent flashes off;

a temperature measuring device to measure the temperature in the processing bath; and a flash temperature judging device to judge whether the temperature in the processing bath is equal to the flash temperature or not by comparing the temperature measured by the temperature measuring device with the flash temperature memorized in the flash-temperature-data memorizing device, wherein the flash preventing device decreases at least one of the concentration of the vaporized solvent or the temperature in the processing bath in response to a judgement by the flash temperature judging device that the temperature measured by the temperature measuring device is equal to the flash temperature memorized in the flash-temperature-data memorizing device.

* * * * *